US006343396B1

(12) United States Patent
Simovitz et al.

(10) Patent No.: US 6,343,396 B1
(45) Date of Patent: Feb. 5, 2002

(54) ROTARY TOOTH CLEANING DEVICE

(76) Inventors: Marius Simovitz, 6 Morad Hayasmin, 34762, Haifa; Zeev Sade, 34 Hahgana, Nahariya; Eran Front, 29 Esther Rabin, Haifa, all of (IL)

( * ) Notice: Subject to any disclaimer, the term of this patent is extended or adjusted under 35 U.S.C. 154(b) by 0 days.

(21) Appl. No.: 09/482,067

(22) Filed: Jan. 13, 2000

(51) Int. Cl.[7] ..... A46B 7/08; A46B 7/10; A46B 13/00

(52) U.S. Cl. ..... 15/27; 15/28; 15/167.2

(58) Field of Search ..... 15/27, 28, 167.2

(56) References Cited

U.S. PATENT DOCUMENTS

| | | | | | |
|---|---|---|---|---|---|
| 1,254,532 | A | * | 1/1918 | Paul | 15/27 |
| 1,338,821 | A | * | 5/1920 | Eisner et al. | 15/28 |
| 3,677,264 | A | * | 7/1972 | Brockman | 15/27 X |

FOREIGN PATENT DOCUMENTS

| | | | | |
|---|---|---|---|---|
| FR | 1300138 | * | 6/1962 | 15/27 |
| GB | 17005 | * | 12/1910 | 15/28 |
| WO | 89/00388 | * | 1/1989 | 15/28 |

* cited by examiner

*Primary Examiner*—Mark Spisich
(74) *Attorney, Agent, or Firm*—Mark M. Friedman

(57) ABSTRACT

A tooth cleaning device having (a) a tooth cleaning head, including: (i) a housing with sides that straddle the tooth along both long faces and defining a longitudinal axis extending between the sides thereof and along the long faces; (ii) gears affixed along respective inner surfaces of the sides of the housing; (iii) tooth cleaning elements affixed along the inner side of the gears and being operatively spaced apart from one another, along the longitudinal axis of the tooth cleaning head, to form a gap therebetween; and (iv) a drive mechanism including: a drive shaft affixed to the inner surfaces of the sides of the housing and spanning the housing, a drive wheel connected to the drive shaft, and transfer gears affixed near ends of the drive shaft and aligned with the gears; and (b) a handle connected to the tooth cleaning head, wherein as the tooth cleaning device travels along a row of teeth, the drive wheel rotates along the biting surface of the teeth, thereby rotating the drive shaft and the transfer gears, the transfer gears in turn providing rotating motion to the gears affixed along the inner surfaces of the sides of the housing and the tooth cleaning elements, such that the long faces of the tooth are cleaned simultaneously by rotary cleaning motion.

14 Claims, 3 Drawing Sheets

ROTARY TOOTH CLEANING DEVICE

FIELD AND BACKGROUND OF THE INVENTION

The present invention relates to rotary tooth cleaning devices and, in particular, it concerns manually powered rotary tooth cleaning devices that simultaneously brush both faces of a tooth.

Many prior-art devices, including those disclosed in U.S. Pat. No. 4,498,209, Australian Patent 449,836 and Belgium Patent 640,683, enable a user to brush both faces of his teeth at one time rather than brushing them separately with a brush having a single set of bristles. Such prior-art devices do not, however, improve the quality of the cleaning of the teeth, nor do they improve the massaging of the gums.

It has long been recognized that previously unattainable dental cleaning benefits can be achieved with a toothbrush that has twin rotary brushes that straddle the teeth and reciprocate angularly in unison. For example, in U.S. Pat. No. 4.048,690 to Wolfson, a toothbrush is disclosed which includes such rotary brushes, as well as an upwardly directed and a downwardly directed stationary brush between the rotary brushes. This toothbrush has the advantage of being able to clean both surfaces of both rows of teeth and the biting edges simultaneously. Since the toothbrush is powered, the rotary brushes are particularly effective at abradably removing plaque and sweeping it away. The stationary brushes that clean the biting surfaces of the teeth are utilized by moving the entire toothbrush. As cited in the literature, the construction of this toothbrush is to be too large and unwieldy to fit and operationally function within the mouths of persons having average or small mandibles.

U.S. Pat. No. 4,766,630 to Hegemann discloses a powered toothbrush that includes a pair of longitudinally extending, reciprocal stroke arms extending between the rotary brushes and disposed above and below their axis of rotation, respectively. The stroke arms are secured by axially directed pins between the rotary brushes, and the portion of the upper arm between the rotary brushes includes upwardly directed bristles, while the portion of the lower stroke arm includes downwardly directed bristles. When the stroke arms are oppositely reciprocated, annular movement of the rotary brushes is achieved. At the same time, the bristles on the stroke arm achieve reciprocal linear movement. However, the use of dual reciprocal arms requires a bulky body that interferes with convenient use of the brush. In addition, repeated activation of the trigger-like mechanism is tiresome and decidedly inconvenient for the user.

In U.S. Pat. No. 5,177,826 to Vrignaud et al., a powered toothbrush is provided with a pair of disk-like rotary brushes mounted for rotation about an axis generally perpendicular to the length of the brush. The rotary brushes are in axially spaced relationship and are provided with inwardly directed bristles. Between the rotary brushes, upper and lower linear brushes are mounted above and below the axis of rotation for linear reciprocating motion generally perpendicular to that axis. The upper brush has upwardly directed bristles, and the lower brush has downwardly directed bristles, and the linear brushes are mounted to the rotary brushes so as to be brought into reciprocal, linear movement when the rotary brushes are reciprocated angularly. Reciprocal motion can then be applied to one of the linear brushes or to the rotary brushes, in order to bring the entire mechanism into reciprocal motion. However, the means for providing the reciprocating, rotary motion to the rotary brush are at least partially disposed in the main body of the brush, such that the main body is bulky and unsuitable for convenient insertion and operation inside the mouth. Moreover, as in previously-described rotary brushes, the device is extremely complex and costly.

U.S. Pat No. 4,223,417 to Solow discloses a gliding, mechanized toothbrush comprising a handle and a small head that encloses a pair of brushes adapted to brush both sides of a tooth at a time. In a preferred embodiment, additional brushes clean the biting surfaces of the teeth. Preferably, the head is mounted on a swivel so that the head can be turned relative to the handle, facilitating brushing teeth in various parts of the mouth. The bristles of the brushes are made to vibrate back and forth along their axes, which is helpful in cleaning the sulcus areas, the embrasures, and the teeth. Various mechanical means can be employed to actuate the brushes, such as vibrating rods or strings or reciprocating cams or gears, but preferably the actuation of the brushes is accomplished by means of a flexible tube leading to a source of alternating vacuum and pressure. One advantage of using a source of alternating vacuum and pressure is that the main body of the toothbrush is relatively sleek relative to the cumbersome and unwieldy devices described above, however, such actuating means are clearly impractical for routine household use. Moreover, the vibratory motion does not have all the advantages manifested in the reciprocating motion of rotary brushes.

There is therefore a need for, and it would be highly advantageous to have a compact toothbrush that simultaneously cleans the front and back surfaces of the tooth using reciprocating motion provided by rotary brushes in a more convenient and efficient fashion than is known heretofore. It would be of further advantage to have a toothbrush with a mechanism that provides an effective cleaning action even for those who are unskilled or lax regarding the requisite techniques of brushing using conventional toothbrushes. It would be of further advantage to have a toothbrush that provides a cleaning action directed towards the interstitial areas that are largely inaccessible to standard toothbrushing devices. Finally, it would be greatly advantageous to have a simple and economical toothbrush that is powered manually by the user, and in a manner similar to the manner of brushing with toothbrushes of ordinary design.

SUMMARY OF THE INVENTION

It is therefore an object of the present invention to provide a tooth cleaning device that simultaneously cleans the front and back surfaces of the tooth.

It is another object of the present invention to provide effective cleaning action for the front and back surfaces of the tooth and gums, and for the interstitial areas between adjacent teeth using reciprocating motion provided by rotary brushes.

It is yet another object of the present invention to provide a tooth cleaning device that enables such effective cleaning in a more compact, simple, and convenient fashion than is known heretofore.

Another object of the present invention is to provide such a tooth cleaning device that is powered manually by the user, and in a manner similar to the manner of brushing with toothbrushes of ordinary design.

It is another object of the present invention to provide a straddle-type tooth cleaning device that guides the user along the teeth and gums, such that effective cleaning is attained even when the head of the implement is out of sight of the user.

It is a further object of the present invention to provide tooth cleaning device that enables effective cleaning action even for users who are lax or unskilled in the proper techniques of brushing.

According to the present invention is provided a straddle type tooth cleaning device for cleaning both sides of a tooth simultaneously by rotary motion, wherein said rotary motion is powered by the movement of said tooth cleaning device along the biting surface of said tooth.

In a preferred embodiment, a tooth cleaning device is provided which comprises a tooth cleaning head, including a housing with sides that straddle the tooth along both long faces, gears affixed along the inner surface of sides of said housing, tooth cleaning elements affixed along the inner side of said gears, said tooth cleaning elements being operatively spaced apart from one another, transverse the longitudinal axis of said tooth cleaning head, to form a gap therebetween, a drive mechanism comprising a drive shaft affixed to said inner surface of sides of said housing and spanning said housing, transverse the longitudinal axis of said tooth cleaning head, a drive wheel connected to said drive shaft, transfer gears affixed near ends of said drive shaft and aligned with said gears, and a handle connected to said tooth cleaning head, wherein as the tooth cleaning device travels along a row of teeth, the drive wheel rotates along the biting surface of the teeth, thereby rotating said drive shaft and said transfer gears, with the transfer gears in turn providing rotating motion to said gears affixed along the inner surface of sides of the housing and the tooth cleaning elements, such that the long faces of the tooth are cleaned simultaneously by rotary cleaning motion.

A preferred embodiment further comprises at least one brush for cleaning the biting surface of the tooth. In a preferred embodiment, the drive wheel comprises tooth cleaning means on the outer surface which contact the biting surface of the tooth.

In a preferred embodiment, each said tooth cleaning element has a brush. In another preferred embodiment, each said tooth cleaning element comprises a cluster of two or more brushes.

In another preferred embodiment, each said brush comprises bristles of varying length and orientation. In yet another preferred embodiment, the bristles are oriented towards the sulcus.

In a preferred embodiment, the gear ratio between said transfer gears and said gears affixed along the inner surface of sides of said housing ranges from about one to one to about twenty to one.

In a preferred embodiment, the drive wheel is adapted to grip the biting surface of the tooth. In another preferred embodiment, the drive wheel has a soft outer surface, thereby providing improved contact between said drive wheel and the biting surface of the tooth.

A preferred embodiment further comprises means for adjusting said gap between said tooth cleaning elements. In another preferred embodiment, these means for adjusting comprise a spring positioned between said inner surface of sides of said housing and said gear. In yet another preferred embodiment, the means for adjusting the gap are provided by pressure exerted by the sides of the housing.

In a preferred embodiment, the head of the tooth cleaning device is mounted on a swivel arrangement, such that the head can be turned relative to the handle, thereby facilitating the brushing in various parts of the mouth. In another preferred embodiment, the swivel arrangement is limited to a range of desired angles with respect to the handle.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a straddle type tooth cleaning device for cleaning both sides of a tooth simultaneously by rotary motion, wherein said rotary motion is powered by the movement of said tooth cleaning device along the biting surface of said tooth.

According to the invention, the tooth cleaning device cleans both teeth and gums, dislodges debris from any pockets at the gum line, cleans the interstices between adjacent teeth, and flushes away the debris which is liberated by the device during each of the various cleaning operations.

The principles and operation of the tooth cleaning device according to the present invention may be better understood with reference to the drawings and the accompanying description.

Figure 1A:
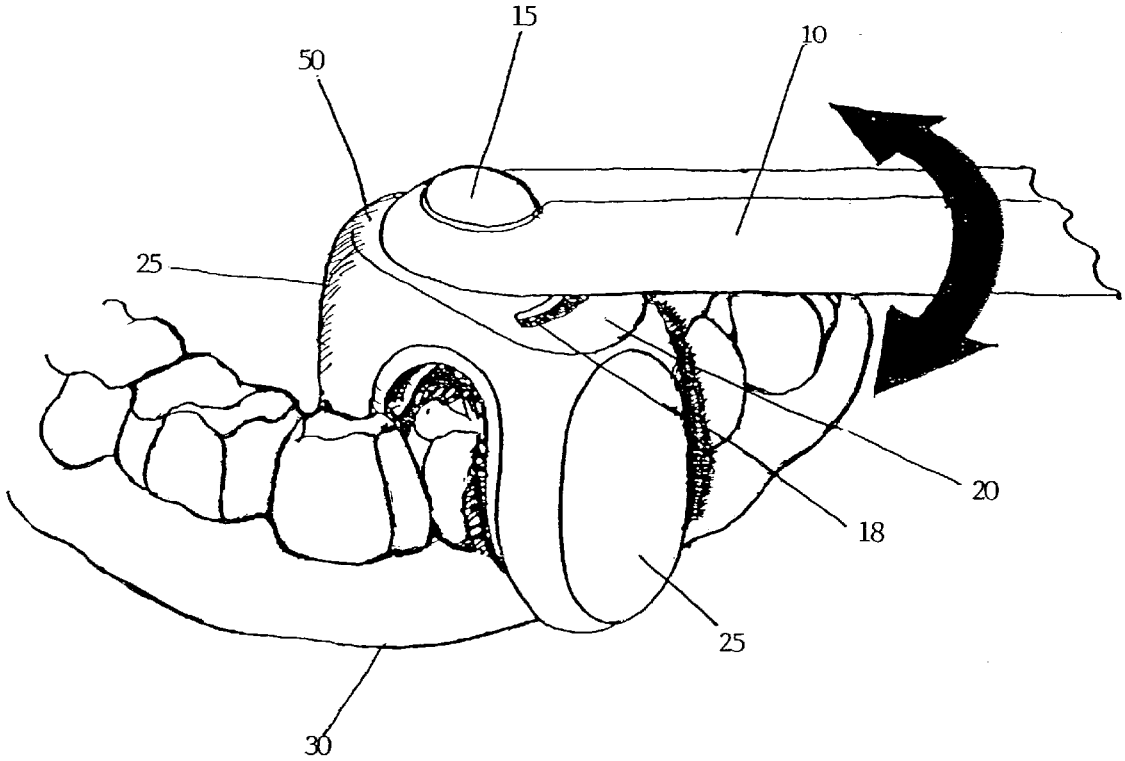
FIG. 1*a* is a perspective view of the straddle type tooth cleaning device according to the present invention, showing the brush in use.

Referring now to the drawings, FIG. 1*a* is a perspective view of the straddle type tooth cleaning device according to the present invention, showing the brush in use. The handle 10 of the device is long and narrow, as in conventional toothbrushes, and is connected to the head housing 50 by means of a swivel arrangement 15 which is shown in greater detail in FIG. 2. In a preferred embodiment, an annular slot 18 in the top 20 of the housing 50 aligns with a nub (shown in FIG. 2) protruding from the bottom face of the handle 10 to fix the angular rotation within desired limits.

The U-shaped head housing 50 has sides 25 that extend on both sides of the tooth, such that the tooth and a portion of the gum are substantially straddled. Within the head housing 50, are affixed rotating brushes that clean the side facings of the tooth, the gums, and the interstitial spaces between adjacent teeth. While the edge of a rotating brush 30 can be seen in FIG. 1*a*, the brush 30 is better viewed in FIG. 1*b*, in which the handle and housing shown in FIG. 1*a* have been removed to reveal the inner workings of the device.

Figure 1B:
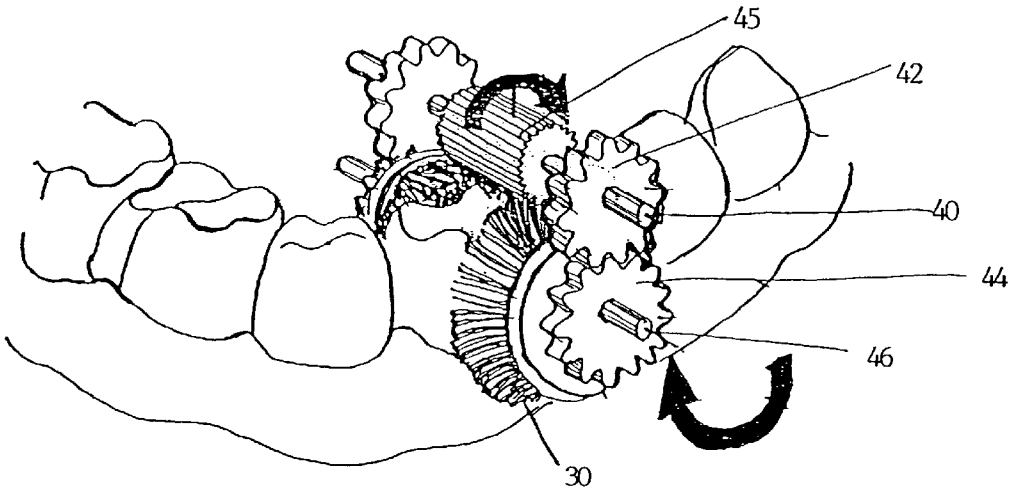
FIG. 1*b* is a perspective view of the straddle type tooth cleaning device shown in FIG. 1*a*, in which the handle and housing have been removed to reveal the inner workings of the device.

Referring now to FIG. 1*b*, the drive comprises a drive shaft 40 that transversely spans the longitudinal axis of the housing (shown in FIG. 1*a*), and is affixed on each end to the inner surface of the sides of the housing. Encompassing the drive shaft 40 is a drive wheel 45. Affixed near each end of the drive shaft 40 is a transfer gear 42. Each transfer gear 42 meshes with the gear teeth of the brush drive gears 44. Each brush drive gear 44 is mounted on a shaft 46 running parallel to the drive shaft 40. Rotary brushes 30 are connected along the inner side of the brush drive gears 44 in a co-axial fashion, such that the rotary brushes 30 face the contact the long sides of the tooth. As the tooth cleaning device travels along a row of teeth, the drive wheel 45 rotates along the biting surface of the teeth, thereby rotating the drive shaft 40 and transfer gears 42. In turn, the transfer gears 42 rotate the brush drive gears 44 along with the rotary brushes 30, such that the long faces of the tooth are cleaned simultaneously by the rotary motion of the brushes 30.

Gear teeth are provided for the entire circumference of gears 42 and 44, such that the transfer gear 42 and brush drive gear 44 are always engaged. The diameter of the brush drive gear 44 is preferably smaller than the diameter of the transfer gear 42, so that every rotation of the drive shaft 40 results in more than one rotation of the rotary brush 30.

The performance of the drive wheel 45 is largely determined by the contact made with the biting surface of the tooth. Under extremely poor contacting conditions, the drive wheel may tend to slide instead of (or in addition to) rotate. Even so, the device according to the present invention provides effective scrubbing of the sides of the tooth, albeit with the back and forth motion characteristic of conventional toothbrushes. To promote better contacting and traction and thereby improve the rotary cleaning action, the drive wheel can be fabricated from various flexible materials that adapt to the shape of the biting surface. Traction can also be promoted by various kinds of grooves or pores made in the surface of the drive wheel.

Figure 2:
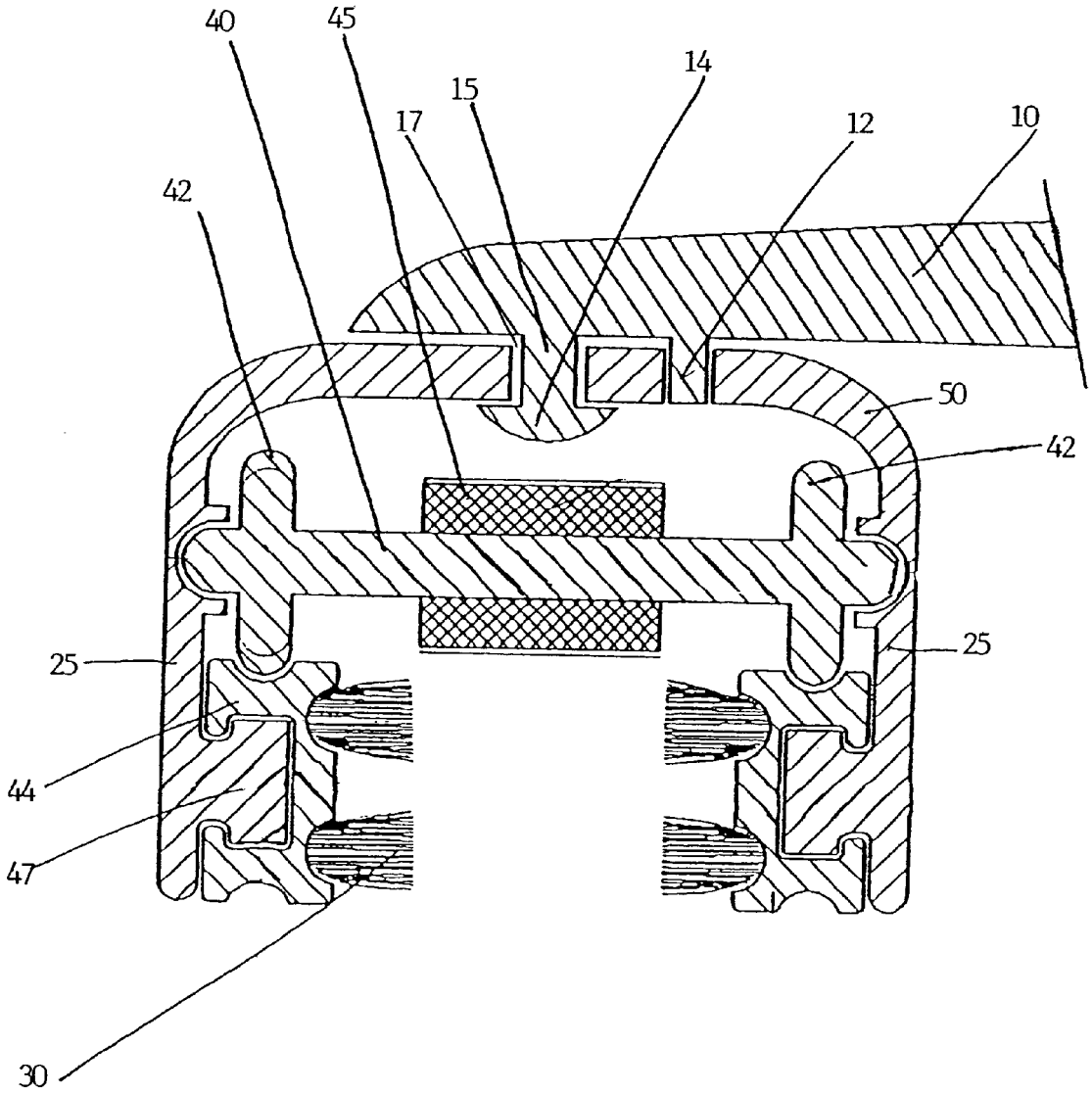
FIG. 2 provides a sectional view of the head and handle of the device, taken laterally through the head assembly.

FIG. 2 provides a sectional view of the head and handle of a presently preferred embodiment of the device, taken laterally through the head assembly. As described above, the handle 10 is affixed to the head housing 50 by means of a nub 15 that extends from the distal end of the handle 10 in a perpendicular manner relative to the long dimension of the handle 10. The nub 15 passes through a narrow opening 17 at the center of the top face 20 of the housing 50. The nub 15 is capped at the distal end with a crown-shaped protrusion 14 that is wider than the opening 17, such that the handle 10 can be swiveled with respect to the head housing 50 but cannot be disattached. Another nub 12 protrudes from the bottom face of the handle 10 through an annular slot 18 in the top 20 of the housing 50 to fix the angular rotation within desired limits.

In a preferred embodiment provided in FIG. 2, several brushes 30 are affixed to each brush drive gear 44. In another preferred embodiment, the rotary brushes 30 and brush drive gear 44 are mounted on a stationary hub 47 which is an integral part of the head housing 50.

Figure 3:
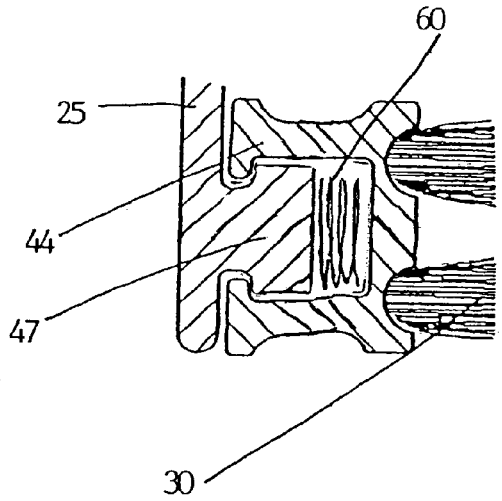
FIG. 3 illustrates a spring inserted between the stationary hub and brush drive gear of FIG. 2.

Since incisors, bicuspids, and molars have characteristically different widths and contact areas, it is desirable to have a self-adjusting feature whereby the rotary brushes always make good contact with the sides of the teeth. This can be achieved in various ways. The sides of the housing can be fabricated with a slight crimp inwards, such that the rotary brushes on opposite sides of the housing are pushed together, with the gap between the brushes being less than the width of the incisors. Thus, when the device is straddled around a tooth, continual pressure is exerted on the sides of the tooth. In a preferred embodiment, a spring 60 can be inserted between the stationary hub 47 and brush drive gear 44 shown in FIG. 3.

Figure 4:
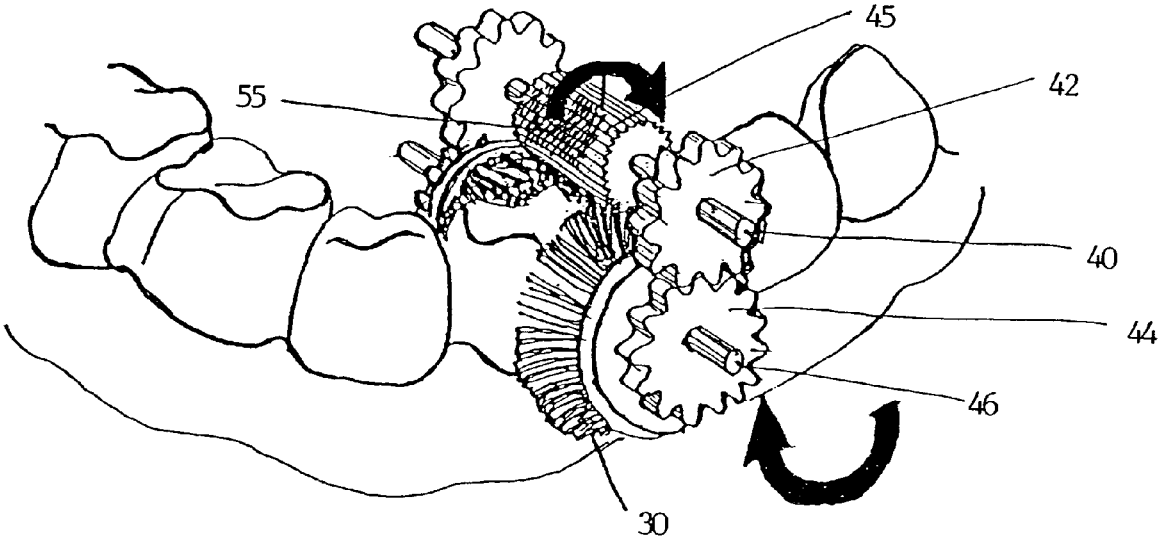
FIG. 4 illustrates the drive wheel of FIG. 1*b* equipped with a tooth cleaning means.

As described above, as the tooth cleaning device travels along a row of teeth, the drive wheel 45 rotates along the biting surface of the teeth, thereby rotating the drive shaft 40 and transfer gears 42. In FIG. 4, drive wheel 45 is equipped with tooth cleaning means 55 on the outer surface of drive wheel 45, for contacting the biting surface of the toothy. Preferably, tooth cleaning means 55 includes at least one brush.

In another preferred embodiment, each said brush comprises bristles of varying length and orientation. This facilitates the cleaning of the faces of the teeth, and in particular, the interstitial spaces between adjacent teeth and the space around the gumline.

It will be appreciated that the above descriptions are intended only to serve as examples, and that many other embodiments are possible within the spirit and the scope of the present invention.

What is claimed is:

1. A tooth cleaning device comprising (a) a tooth cleaning head, including:

(i) a housing with sides that straddle the tooth along both long faces and defining a longitudinal axis extending between the sides thereof;

(ii) gears affixed along respective inner surfaces of the sides of said housing;

(iii) tooth cleaning elements affixed along the inner side of said gears, said tooth cleaning elements being operatively spaced apart from one another, along the longitudinal axis of said tooth cleaning head, to form a gap therebetween; and (iv) a drive mechanism comprising:

A. a drive shaft affixed to said inner surfaces of the sides of said housing and spanning said housing;

B. a drive wheel connected to said drive shaft;

C. transfer gears affixed near ends of said drive shaft and aligned with said gears; and (b) a handle connected to said tooth cleaning head, wherein as said tooth cleaning device travels along a row of teeth, said drive wheel rotates along the biting surface of the teeth, thereby rotating said drive shaft and said transfer gears, said transfer gears in turn providing rotating motion to said gears affixed along the inner surfaces of the sides of said housing and said tooth cleaning elements, such that said long faces of the tooth are cleaned simultaneously by rotary cleaning motion.

2. The tooth cleaning device of claim 1, wherein each of said tooth cleaning elements has a brush.

3. The tooth cleaning device of claim 2, wherein said brush comprises bristles oriented towards the sulcus.

4. The tooth cleaning device of claim 1, wherein each of said tooth cleaning elements comprises a cluster of two or more brushes.

5. The tooth cleaning device of claim 1, wherein the gear ratio between said transfer gears and said gears affixed along the inner surfaces of the sides of said housing ranges from about one to one to about twenty to one.

6. The tooth cleaning device of claim 1, wherein said drive wheel comprises tooth cleaning means on an outer surface of said drive wheel, said tooth cleaning means contacting the biting surface of the tooth.

7. The tooth cleaning device of claim 6 wherein said tooth cleaning means includes at least one brush to clean the biting surface of the tooth.

8. The tooth cleaning device of claim 1, wherein said drive wheel is adapted to grip the biting surface of the tooth.

9. The tooth cleaning device of claim 1, wherein said drive wheel has a soft outer surface, thereby providing improved contact between said drive wheel and the biting surface of the tooth.

10. The tooth cleaning device of claim 1, further comprising means for adjusting said gap between said tooth cleaning elements.

11. The tooth cleaning device of claim 10, wherein said means for adjusting comprise a spring positioned between said inner surfaces of the sides of said housing and the respective gears mounting said tooth cleaning elements.

12. The tooth cleaning device of claim 10, wherein said means for adjusting are provided by pressure exerted by said sides of said housing.

13. The tooth cleaning device of claim 1, wherein said handle is connected to said tooth cleaning head by means of a swivel arrangement.

14. The tooth cleaning device of claim 13, whereby said swivel arrangement is limited to a range of desired angles with respect to said handle.

* * * * *